US006408556B1

(12) United States Patent
Achee et al.

(10) Patent No.: US 6,408,556 B1
(45) Date of Patent: Jun. 25, 2002

(54) BREECH BLOCK FIREARM SAFETY DEVICE

(76) Inventors: John D. Achee, 134 Belmont Dr.; Richard L. Zaharek, 105 Highfield Dr., both of Torrington, CT (US) 06790

( * ) Notice: Subject to any disclaimer, the term of this patent is extended or adjusted under 35 U.S.C. 154(b) by 0 days.

(21) Appl. No.: 09/931,426

(22) Filed: Aug. 16, 2001

(51) Int. Cl.[7] ..... F41A 17/00
(52) U.S. Cl. ..... 42/70.11
(58) Field of Search ..... 42/70.11, 90

(56) References Cited

U.S. PATENT DOCUMENTS

| | | | | | |
|---|---|---|---|---|---|
| 2,479,107 | A | | 8/1949 | Garretson | 42/70 |
| 2,836,918 | A | * | 6/1958 | Pula et al. | 42/1 |
| 3,360,880 | A | * | 1/1968 | Finnegan | 42/66 |
| 3,444,639 | A | | 5/1969 | Rockwood | 42/1 |
| 3,708,901 | A | * | 1/1973 | Wolter | 42/1 |
| 4,048,741 | A | * | 9/1977 | Chiodo et al. | 42/1 |
| 4,224,753 | A | * | 9/1980 | Bielman | 42/70.11 |
| 4,398,366 | A | | 8/1983 | Wernicki | 42/1 LP |
| 4,776,123 | A | | 10/1988 | Ascroft | 42/70.11 |
| 4,783,924 | A | * | 11/1988 | Thurber | 42/70.11 |
| 5,048,211 | A | | 9/1991 | Hepp | 42/70.11 |
| 5,070,635 | A | | 12/1991 | Cvetanovich | 42/70.11 |
| 5,289,653 | A | * | 3/1994 | Szebeni et al. | 42/70.11 |
| 5,291,832 | A | * | 3/1994 | Plummer | 42/90 |
| 5,347,739 | A | * | 9/1994 | Stuart | 42/70.11 |
| 5,410,832 | A | * | 5/1995 | Barnhart | 42/70.11 |
| 5,450,685 | A | * | 9/1995 | Peterson | 42/70.11 |
| 5,488,794 | A | * | 2/1996 | Arrequin | 42/70.11 |
| 5,918,403 | A | * | 7/1999 | Lurz et al. | 42/70.11 |
| 5,934,000 | A | * | 8/1999 | Hayes, Sr. | 42/95 |
| 6,041,536 | A | * | 3/2000 | Samuels et al. | 42/70.11 |
| 6,237,272 | B1 | | 5/2001 | Scott | 42/70.11 |
| 6,250,008 | B1 | | 6/2001 | Silver | 42/70.01 |

FOREIGN PATENT DOCUMENTS

| | | | |
|---|---|---|---|
| WO | WO 00/17596 | 3/2000 | F41A/17/44 |

* cited by examiner

*Primary Examiner*—David M. Mitchell
*Assistant Examiner*—Denise J Buckley

(57) ABSTRACT

A breech block firearm safety device for the prevention of injury to children having unauthorized access to loaded firearms. This device will also protect gun owners from injury due to mishandling or the dropping a loaded weapon. The safety device utilizes a two piece blocking assembly having a breech member and a bore member. The breech member is inserted into the breech just as you would insert a live round to arm a weapon. The bore member is inserted into the muzzle of the firearm and screw connected to the breech member using special tooling. The chamber blocking assembly can be easily extracted but the overall length is such that the end of the bore member remains in the breech making ejection impossible. The assembly can only be returned to the breech, making manual or automatic loading of live ammunition impossible. When the above safety device is installed in a revolver the overall length prevents the rotation of the cylinder and prevents the loading of live ammunition into firing position.

4 Claims, 3 Drawing Sheets

BREECH BLOCK FIREARM SAFETY DEVICE

BACKGROUND—FIELD OF INVENTION

This invention relates to firearm safety devices, specifically to firing chamber blocking devices.

BACKGROUND—DESCRIPTION OF PRIOR ART

A major concern of gun owners and law enforcement officials is the fact children may gain unauthorized access to loaded guns with the consequence of someone being injured or killed. There is also concern that a gun owner may accidentally drop a loaded gun causing an unintentional discharge of the weapon.

Presently there are gun lock devices on the market that have not been entirely satisfactory. Some of these lock into the trigger guard behind the trigger thereby preventing the trigger being pulled. This device does not insure that there is not a live bullet in the firing chamber or breech allowing unintentional discharge of the firearm should it be dropped or handled improperly. There are several cable lock devices in which the breech is partially blocked or in the case of revolver the cylinder is locked out of position. In either case a live bullet can not be loaded into the breech but the firearm has to be left open allowing debris to invade the barrel, breech or the cylinder of the firearm.

ROCKY MOUNTAIN TOOL & ARMORY offers a gun lock that prevents loading live ammunition into the breech but is relatively expensive to manufacture and when used on a automatic or repeating firearm it allows live cartridges to be extracted from a loaded magazine and brought into contact with the breech blocking mechanism and causing jamming of the firearm.

Inventors have created several breech blocking gun locks to prevent the loading of live ammunition into the breech or firing chamber with lock installed. U.S. Pat. No. 5,412,959 to Bentley (1995) discloses a breech blocking that is rather expensive to manufacture and requires the use of a combination lock. When used on a automatic or repeating firearm this mechanism allows live ammunition to be extracted from a loaded magazine and be brought into forcible contact with the breech blocking mechanism causing jamming of the firearm. U.S. Pat. No. 2,479,107 (1949) to Garrison teaches a breech blocking gun lock with a locking blocking rod. This gun lock can be applied a revolver,an automatic pistol or rifle but not to a smooth bore firearm such as a shotgun. This mechanism also allows extraction of live ammunition from a magazine which can cause jamming and damage to the firearm when used on an automatic or repeating firearm.

U.S. Pat. Nos. 5,048,211 and 4,398,366 issued to Hepp and Wernicki respectively and international publication number WO 00/17596 to Hutton teach the locking of a dummy shell in the breech to prevent the entry of a live cartridge into the breach. No mention is made of deactivating the extractor or the consequences of trying to eject a dummy cartridge that is locked in place. U.S. Pat. No. 6,041,536 to Samuels teaches a breech blocking gun lock to be used on a revolver only. U.S. Pat. No. 6,237,272 B1 issued to Randy Lee Scott (2001) and U.S. Pat. No. 5,070,635 issued to David A. Cventanovich both teach chamber blocking plugs held in place by "O" rings. Both may be installed in automatic or repeating firearms but neither prevent the extraction of ammunition from a magazine. Both may be installed in a revolver but neither offer protection from the rotation of the cylinder causing live ammunition to be placed in firing position unless a safety plug is inserted into each chamber of the revolver. U.S. Pat. No. 6,226,914 issued to Reed, May 8, 2001 specifies use on open port firearms thereby excluding revolvers.

SUMMERY

In accordance with the present invention a gun safety device comprises a receiver blocking member and a bore blocking member and means to connect the two members providing an overall length approximately 20 percent longer than the ejection clearance of the firearm to be protected.

OBJECTS AND ADVANTAGES

Several objects and advantages of the present invention are:

(a) to provide a gun safety device that is easy to install but difficult for a child to remove without proper tooling and instructions;

(b) to provide a gun safety device that is inexpensive to manufacture and requires no maintenance;

(c) to provide a gun safety device that will not effect the action of the firearm or damage any part thereof;

(d) to provide a gun safety device that is suitable for use on most firearms having an ejection mechanism with a specific ejection clearance dimension;

(e) to provide a gun safety device that is suitable for use on revolvers;

(f) to provide a gun safety device that can be easily removed by the insertion of a specialized tool into the muzzle of the firearm.

DRAWING FIGURES

In the drawings closely related figures have the same number but different alphabetic suffixes FIG. 1 shows a partially sectioned disassembled breech block safety device.

DESCRIPTION OF THE PREFERRED EMBODIMENT

The novel firearm safety device will now be described by reference to FIGS. 1–5 . The gun safety device is generally designated numeral 10 and its primary components are breech member 15 and bore member 20 Breech member 15 has the same external configuration and dimensions as the shell portion of the ammunition to be used in gun to be protected. The breech member 15 can in fact be assembled using an unprimed shell casing filled with a soft metal such as as brass or aluminum as well as a hard plastic or nylon. The axis of the breech member 15 is drilled and threaded for acceptance of connecting means 25.

Figure 1:
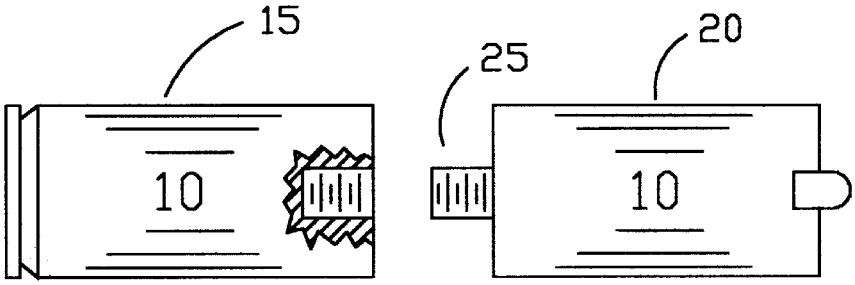
Figure 3C:
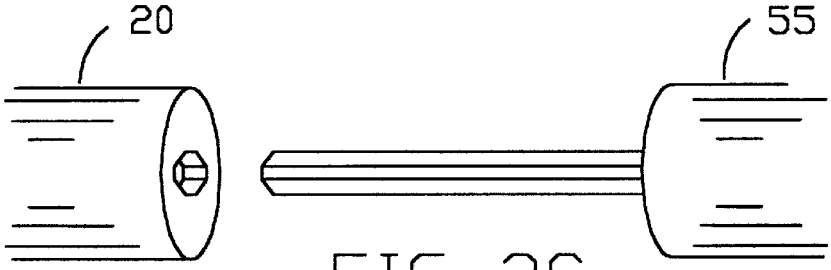
FIGS. 3A to 3C show views of specialized tooling having different driving means for assembly and removal of the bore member of the safety device.
Figure 3B:
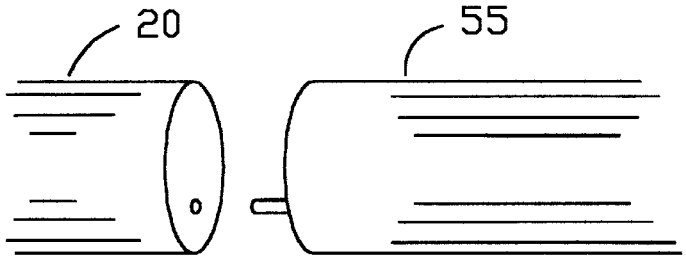
Figure 3A:
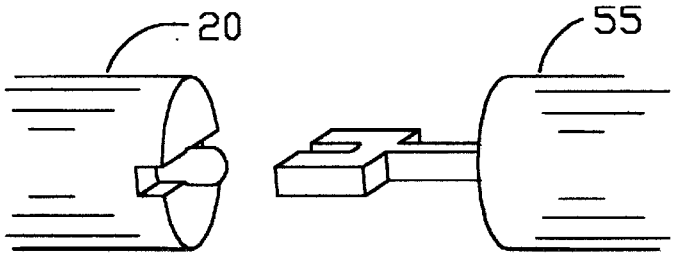
Figure 2:
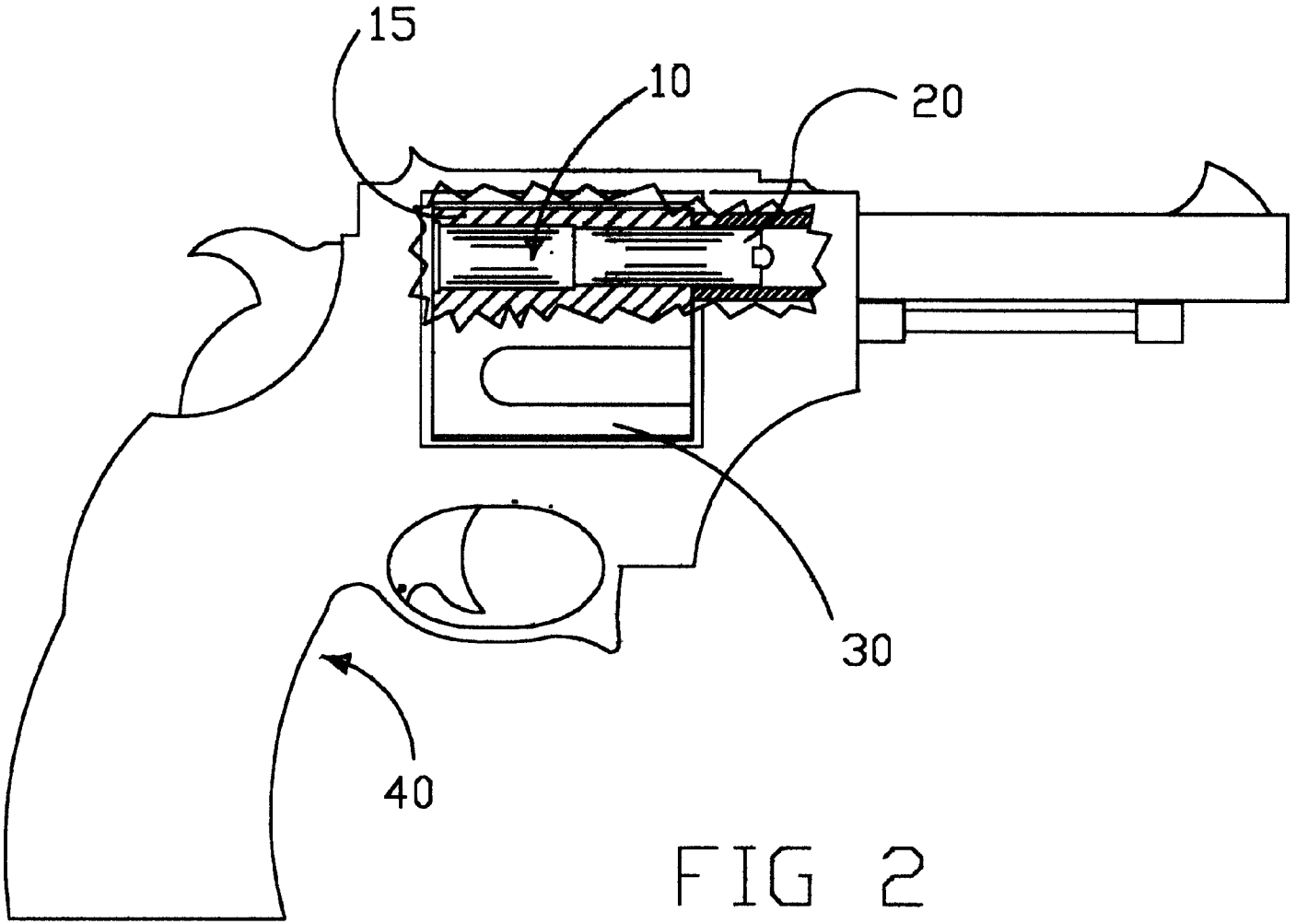
FIG. 2 shows a partially sectioned view of a revolver with an assembled breech block safety device installed preventing rotation of the cylinder.
Figure 4:
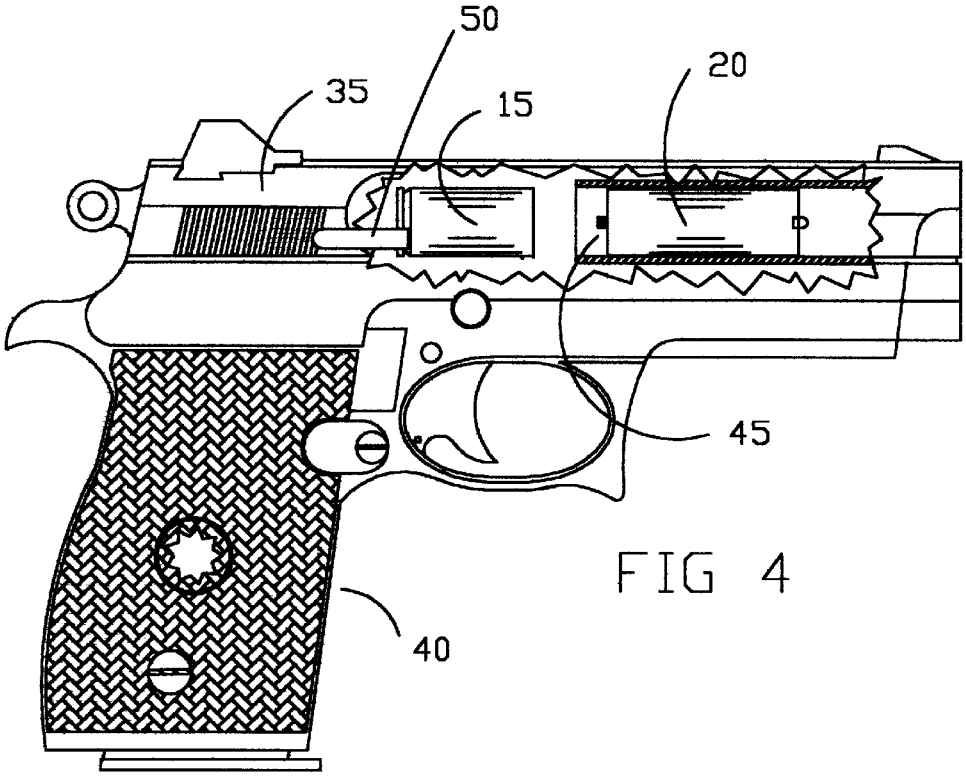
FIG. 4 shows a partially sectioned view of an automatic pistol with a breech member locked into the breech and a disassembled bore member in the barrel.
Figure 5:
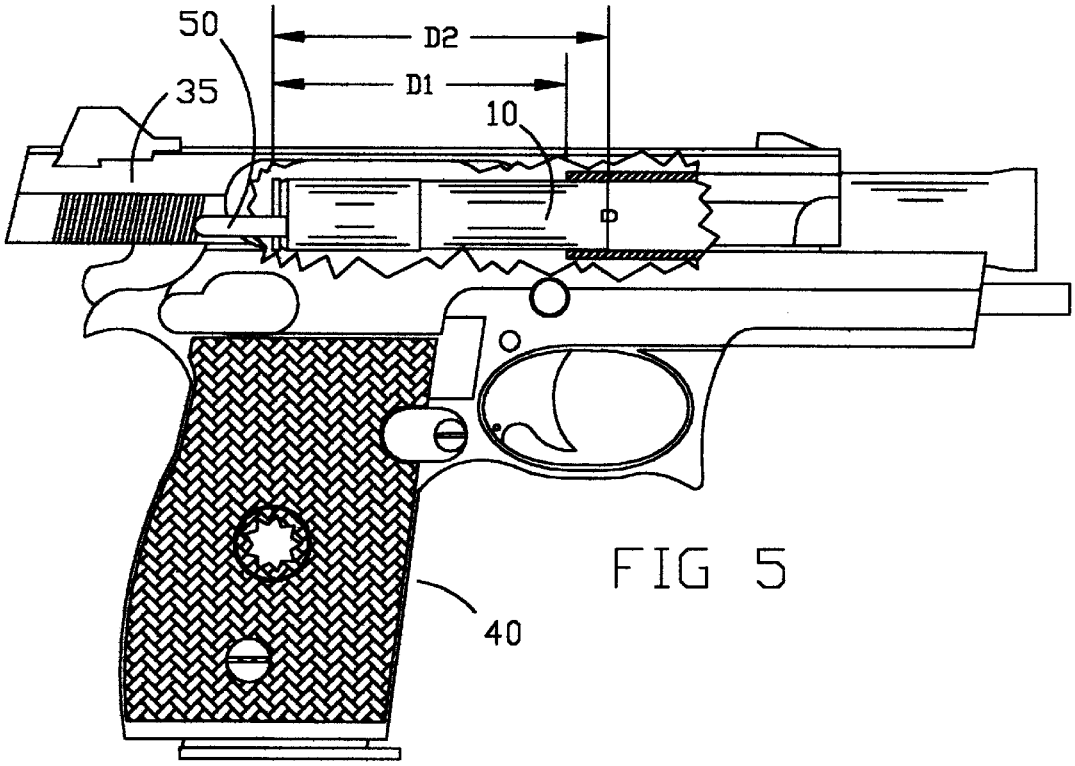
FIG. 5 shows a partially sectioned view of an automatic pistol with a breech block safety device extracted to the eject position with the bore member partially in the breech.

Bore member 20 is a soft metal or hard plastic or nylon cylinder having a diameter approximately 0.010 of an inch less than the minimum diameter of the bore of the barrel to be protected and having a length that when connected to the breech member 15 produces an overall length D2 approximately 20% longer than the ejection clearance length D1. The axis of the breach end of the bore member is fitted with a threaded connecting means 25 for connection of the bore member 20 to the breech member 15 as seen in FIG. 1 FIGS. 3A to 3C show some of many possible configurations of specialized tooling for the installation and removal of the gun safety device. FIG. 2 shows the gun safety device 10 installed in a revolver. The breech member 15 and bore member 20 are exactly as described above except that the overall length of the assembly 10 need be only approximately 10% longer than the length of the revolver cylinder 30.

The installation of the gun safety device can be easily and safely accomplished in the following manner.

For automatic and semiautomatic fire arms . . .

(a) Remove magazine from the firearm and any live cartridges from the breech or firing chamber.

(b) Open access to the breech and insert breech member 15 into the breech or firing chamber.

(c) Lock breech member 15 in place by moving slide 35 into the closed position.

(d) Insert bore member 20 breech end 45 first into muzzle of the barrel and connect the bore member 20 to the breech member 15 using tooling specified for the safety device employed.

(e) Move the slide 35 back to the eject position and check to insure that the two members are correctly connected and the breech member 15 is not ejected.

(f) The magazine may now be installed.

For use on revolvers . . .

(a1) Remove all live ammunition and empty casings from the revolver cylinder 30.

(b1) Insert the breech member 15 into the cylinder 30 of the revolver.

(c1) Insert live cartridges into the remaining chambers of the revolver cylinder 30.

(d1) Return cylinder to the closed position and manually rotate the cylinder to align the breech member 15 with the revolver barrel.

(e1) Insert the bore member 20 breech end 45 first into the muzzle of the revolver barrel and connect the two members using tooling 55 specified for the safety device employed.

(f1) Invert the revolver (muzzle pointed vertically down) and ensure that the muzzle member 20 does not fall free and that the chamber 30 can not be rotated manually.

Note: For added safety insertion of live rounds or insertion of a loaded magazine may be postponed until after removal of the safety device and prior to intentional discharge of the firearm. Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

We claim:

1. A breech block firearm safety device in combination with a fire arm having a breech, a barrel having a breech end and a bore end, said firearm having a caliber, an action, a cartridge extractor, an ejection mechanism having specific ejection clearance dimensions, the breech block firearm safety device comprising:

a) a solid one piece single casing breech member, having a breech end and a bore end, for insertion into said breech and preventing unintentional loading of said firearm, said breech member having the same outside dimensions and configuration as a single casing of said firearm caliber ammunition, and having said bore end tapped to accept an attaching means;

b) a solid cylindrical bore member having a breech end and a bore end, said breech end fitted with said attaching means for attaching said bore member to said breech member, said bore member having a diameter slightly less than the diameter of said barrel, and having sufficient length to produce an assembled breech block firearm safety device longer than said ejection clearance.

2. The bore member recited in claim 1 wherein the bore end is configured to accept specialized tooling for the attachment of said bore member to said breech member and removal of said bore member from said breech member.

3. A fire arm breech block safety device in combination with a firearm having multiple breech cavities contained within a cylinder, a barrel having a breech end and a bore end, said firearm having a caliber, the breech block firearm safety device comprising:

a) a solid one piece single casing breech member, having a breech end and a bore end, for insertion into one of said breech cavites and preventing unintentional loading of said firearm, said breech member having the same outside dimensions and configuration as a single casing of said firearm caliber ammunition, and having said bore end tapped to accept an attaching means;

b) a solid cylindrical bore member having breech end and a bore end and a diameter slightly less than the bore of said barrel and having sufficient length to produce an assembled firearm safety device longer than the breech cavities in said cylinder and prevent the rotation of said cylinder, and having said attaching means attached to the bore end of said bore member.

4. The bore member as recited in claim 3 wherein the bore end of said bore member is configured to accept specialized tooling for the attachment and removal of the bore member from the breech member.

* * * * *